US005386276A

United States Patent [19]

Swales et al.

[11] Patent Number: 5,386,276

[45] Date of Patent: Jan. 31, 1995

[54] DETECTING AND CORRECTING FOR LOW DEVELOPED MASS PER UNIT AREA

[75] Inventors: Michael G. Swales, Sodus; John D. Sotack, Rochester, both of N.Y.

[73] Assignee: Xerox Corporation, Stamford, Conn.

[21] Appl. No.: 89,208

[22] Filed: Jul. 12, 1993

[51] Int. Cl.[6] ..... G03G 21/00

[52] U.S. Cl. ..... 355/246; 355/203; 355/208; 430/30

[58] Field of Search ..... 355/208, 203, 204, 206, 355/205–209, 246; 364/518, 525, 551.01, 200, 264, 264.5; 118/657, 654, 658, 653, 688–692; 430/120, 30

[56] References Cited

U.S. PATENT DOCUMENTS

| | | | |
|---|---|---|---|
| 4,341,461 | 7/1982 | Fantozzi | 355/246 |
| 4,572,654 | 2/1986 | Murai et al. | 355/246 X |
| 4,639,117 | 1/1987 | Murai et al. | 355/246 |
| 4,910,557 | 3/1990 | Imai | 355/246 |
| 5,057,866 | 10/1991 | Hill, Jr. et al. | 355/205 X |
| 5,138,377 | 8/1992 | Smith et al. | 355/207 |

*Primary Examiner*—A. T. Grimley
*Assistant Examiner*—Shuk Y. Lee
*Attorney, Agent, or Firm*—Ronald Chapuran

[57] ABSTRACT

A method of maintaining consistent large solid area development by developing a large area test patch covering the image area of a photorececptor and detecting the lead edge and trail edge density of the test patch using a densitometer to measure reflectance and comparing the lead and trail edge density to the lead and trail edge density of a reference patch. The reference patch is generated after the changing of developer elements such as developer material and photoreceptor and an electrostatic set up performed. Alternatively a density differential between lead and trail edge density of the test patch is detected. Electrostatic parameters such as preset toner concentration control values and decreasing the development field of the test patch are adjusted to maintain constant large solid area development.

21 Claims, 5 Drawing Sheets

DETECTING AND CORRECTING FOR LOW DEVELOPED MASS PER UNIT AREA

BACKGROUND OF THE INVENTION

The invention relates to optimization of the xerographic process, and more particularly, to the automatic compensation for toner concentration drift due to developer aging.

One benchmark in the suitable development of a latent electrostatic image on a photoreceptor by toner particles is the correct toner concentration in the developer. An incorrect concentration, i.e. too much toner concentration, can result in too much background in the developed image. That is, the white background of an image becoming gray. On the other hand, too little toner concentration can result in deletions or lack of toner coverage of the image. Generally, the aging characteristics of developer material is that toner concentration decreases over time. As toner concentration decreases, solid areas become lighter.

Under prior art process controls, a relatively small toner control patch is developed and sensed to adjust the development process to maintain the quality of developed small solid areas.

Specifically, many machines (both copiers and printers) use optical feed back from toner patches to control DMA (developed mass per unit area). The toner patch is developed to a partially discharged region of a photoreceptor. In toner patch based DMA control systems, the patch voltage is held constant. The controller attempts to keep the reflectance of the toner patch in range using the toner dispenser as an actuator. When the toner patch reflectance is high (the patch is too light) toner is added. The assumption is that if toner is added in such a way that the toner patch reflectance is kept at its target value then the DMA of the printed foreground will be kept at its target. Toner patches are developed to partially discharged belt areas because patches developed to fully charged areas would be saturated black and their reflectance would have insufficient sensitivity to DMA to control toner concentration TC. To create a toner patch on a printer a small region of the photoreceptor is initially left unexposed (fully charged). A special discharge lamp is then used to reduce its surface potential to a target value a fixed number of volts above the developer bias. Toner is then developed to the patch and its reflectance is read by the optical sensor. As the toner patch gets developed toner is deposited on it until the development field is sufficiently neutralized. With highly charged toner, less toner will be developed to the patch and its reflectance will be below target causing toner to be added. With lower charged toner the opposite occurs.

As developer ages, its charging properties degrade and progressively lower toner concentrations are required to keep the toner patch reflectance at target. With some developer, the toner concentration gets set sufficiently low after as little as 30,000 prints that foreground solids can not be properly rendered. In this case sufficient toner is available to keep the low density toner patch at target but not enough toner is available to render the more demanding foreground solid areas.

An example of the prior art is, U.S. Pat. No. 4,999,673, assigned to the same assignee as the present invention, disclosing the use of a relatively small developed half tone image patch to regulate the developer parameters. However, these prior art small patch process controls are generally inadequate and insensitive to detect large solid area development deterioration as discussed above. It would be desirable, therefore, to provide a process control technique to detect deterioration in large, solid area development. It is also known in the prior art to use an electro-optic sensor or any other suitable sensor in the developer housing to determine toner concentration. The use of a sensor in the housing in addition to the IRD sensor normally used in adjusting development, however, adds additional cost and complexity to the system. It would also be desirable, therefore, to minimize additional cost and complexity in a developer control system that is capable of responding to large solid area development deterioration to maintain toner concentration and developed mass at a constant level throughout the life of the developer.

It is an object of the present invention therefore to provide a new an improved technique to detect deterioration in large, solid area development. It is another object of the present invention to minimize additional cost and complexity in a developer control system that is capable of responding to large solid area development deterioration to maintain toner concentration and developed mass at a constant level. Other advantages of the present invention will become apparent as the following description proceeds, and the features characterizing the invention will be pointed out with particularity in the claims annexed to and forming a part of this specification.

SUMMARY OF THE INVENTION

The present invention is concerned with a method of maintaining consistent large solid area development by developing a large area test patch covering the image area of a photoreceptor and detecting the lead edge and trail edge density of the test patch using a densitometer to measure reflectance and comparing the lead and trail edge density to the lead and trail edge density of a reference patch. The reference patch is generated after the changing of developer elements such as developer material and photoreceptor and an electrostatic set up performed. Alternatively a density differential between lead and trail edge density of the test patch is detected. Electrostatic parameters such as preset toner concentration control values and decreasing the development field of the test patch are adjusted to maintain constant large solid area development. Communication with a remote station regarding adjustment or need for adjustment is also contemplated.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
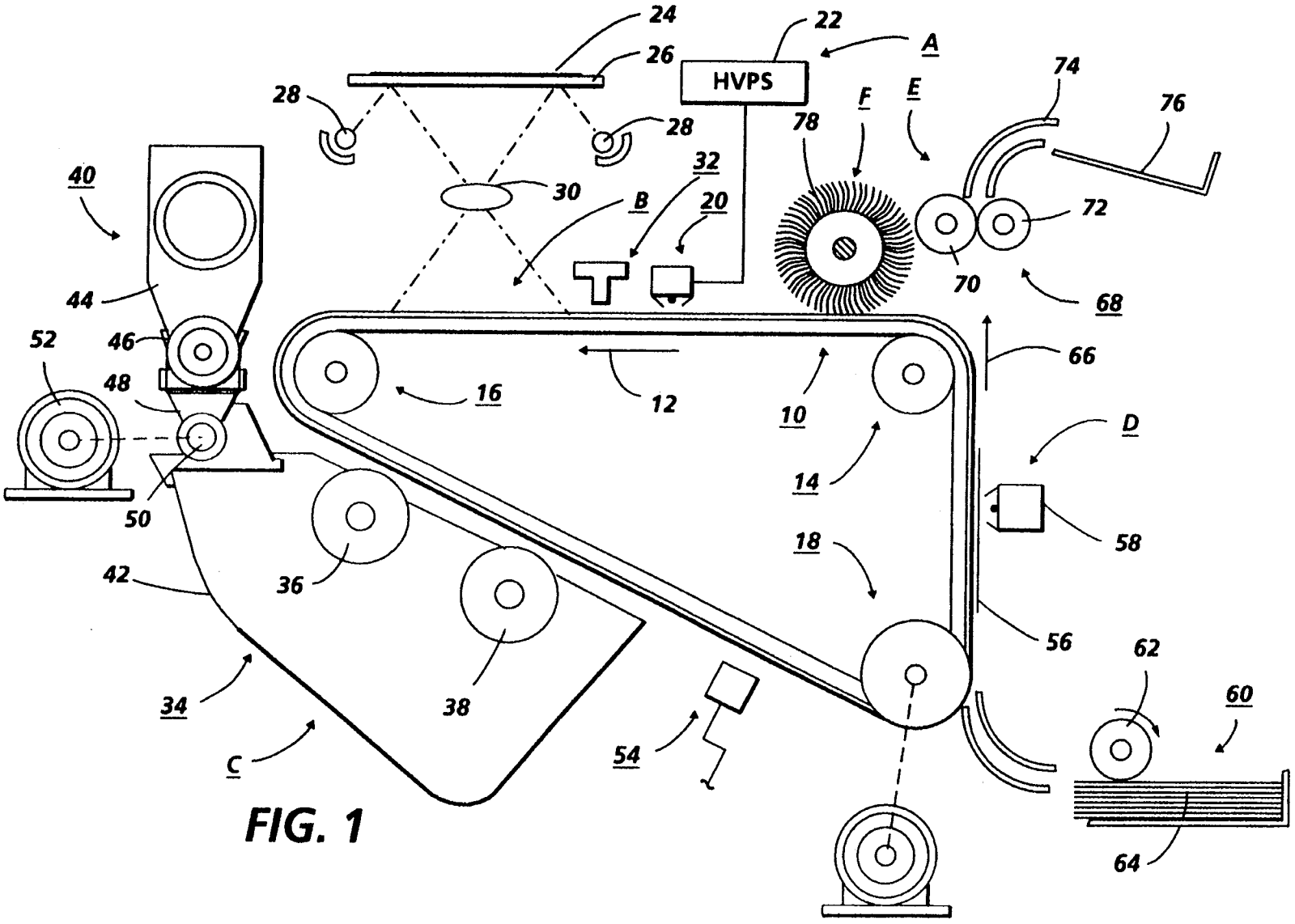
FIG. 1 is a schematic elevational view illustrating a typical electronic imaging system incorporating the features of the present invention.

FIG. 1 schematically depicts an electrophotographic printing machine incorporating the features of the present invention therein. It will become evident from the following discussion that the present invention may be employed in a wide variety of applications such as light lens machines, laser printers, and any other suitable digital copier, and is not specifically limited in its application to the particular embodiment depicted herein.

Referring to FIG. 1 of the drawings, the electrophotographic printing machine employs a photoconductive belt 10. Belt 10 moves in the direction of arrow 12 to advance successive portions of the photoconductive surface sequentially through the various processing stations disposed about the path of movement thereof. Belt 10 is entrained about stripping roller 14, tensioning roller 16, and drive roller 18. At charging station A, a corona generating device, indicated generally by the reference numeral 20, charges the photoconductive belt 10 to a relatively high, substantially uniform potential. Corona generating device 20 includes a generally U-shaped shield and a charging electrode. A high voltage power supply 22 is coupled to the shield A change in the output of power supply 22 causes corona generating device 20 to vary the charge applied to the photoconductive belt 10. Charging station A may be one of the processing stations regulated by the control system depicted in FIG. 2.

Next, the charged portion of the photoconductive surface is advanced through imaging station B. At imaging station B, an original document 24 is positioned face down upon a transparent platen 26. Imaging of a document is achieved by lamps 28 which illuminate the document on platen 26. Light rays reflected from the document are transmitted through lens 30. Lens 30 focuses the light image of the original document onto the charged portion of photoconductive belt 10 to selectively dissipate the charge thereon. This records an electrostatic latent image on the photoconductive belt which corresponds to the informational areas contained within the original document.

Imaging station B includes a test area generator, indicated generally by the reference numeral 32. Test generator 32 comprises a light source projecting light rays onto the charged portion of photoconductive belt 10, in the interimage region, i.e. between successive electrostatic latent images recorded on photoconductive belt 10. A test patch is recorded on photoconductive belt 10 typically a one inch square as shown at 88 in FIG. 3 or any other suitable patch size. The electrostatic latent image and test patch are then developed with toner particles at development station C. In this way, a toner powder image and a developed test patch is formed on photoconductive belt 10. The developed test patch is subsequently examined to determine the quality of the toner image being developed on the photoconductive belt.

At development station C, a magnetic brush development system, indicated generally by the reference numeral 34, advances a developer material into contact with the elctrostatic latent image and test patch recorded on photoconductive belt 10. Preferably, magnetic brush development system 34 includes two magnetic brush developer rollers 36 and 38. These rollers each advance the developer material into contact with the latent image and test areas. Each developer roller forms a brush comprising carrier granules and toner particles. The latent image and test patch attract the toner particles from the carrier granules forming a toner powder image on the latent image and a developed test patch. As toner particles are depleted from the developer material, a toner particle dispenser, indicated generally by the reference numeral 40, furnishes additional toner particles to housing 42 for subsequent use by developer rollers 36 and 38, respectively. Toner dispenser 40 includes a container 44 storing a supply of toner particles therein. A foam roller 46 disposed in sump 48 coupled to container 44 dispenses toner particles into an auger 50. Auger 50 is made from a helical spring mounted in a tube having a plurality of apertures therein. Motor 52 rotates the helical spring to advance the toner particles through the tube so that toner particles are dispensed from the apertures therein. This process station may also be controlled by the control system regulating the energization of motor 52.

Figure 2:
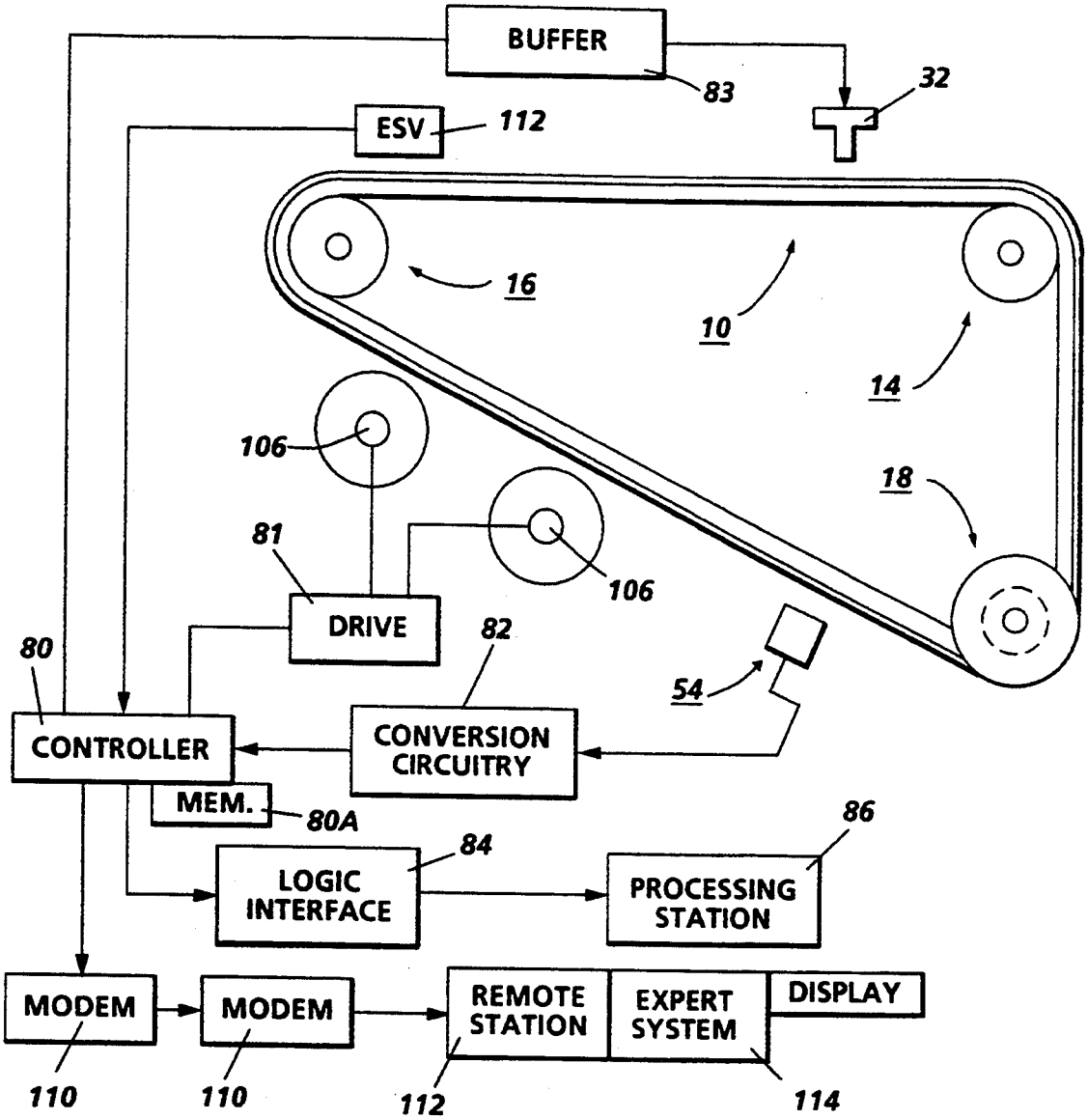
FIG. 2 is a schematic view showing the control system of the system shown in FIG. 1.

A densitometer 54, positioned adjacent the photoconductive belt between developer station C and transfer station D, generates electrical signals proportional to the developed test patch reflectance. These signals are conveyed to a control system and suitably processed for regulating the processing stations of the printing machine. Further details of the control system are shown in FIG. 2. Preferably, densitometer 54 is an infrared densitometer, energized at 15 volts DC and about 50 milliamps. The surface of the infrared densitometer is about 7 millimeters from the surface of photoconductive belt 10. Densitometer 54 includes a semiconductor light emitting diode typically having a 940 nanometer peak output wavelength with a 60 nanometer one-half power bandwidth. The power output is approximately 45 milliwatts. A photodiode receives the light rays reflected from the developed half tone test patch and converts the measured light ray input to an electrical output signal. The infrared densitometer is also used to periodically measure the light rays reflected from the bare photoconductive surface, i.e. without developed toner particles, to provide a reference level for calculation of a suitable signal ratio. After development the toner powder image is advanced to transfer station D.

At transfer station D, a copy sheet 56 is moved into contact with the toner powder image. The copy sheet is advanced to transfer station D by a sheet feeding apparatus 60. Preferably, sheet feeding apparatus 60 includes a feed roll 62 contacting the uppermost sheet of a stack 64 of sheets. Feed rolls 62 rotate so as to advance the uppermost sheet from stack 64 into chute. Chute guides the advancing sheet from stack 64 into contact with the photoconductive belt in a timed sequence so that the toner powder image developed thereon contacts the advancing sheet at transfer station D. At transfer station D, a corona generating device 58 sprays ions onto the backside of sheet 56. This attracts the toner powder image from photoconductive belt 10 to copy sheet 56. After transfer, the copy sheet is separated form belt 10 and a conveyor advances the copy sheet, in the direction of arrow 66, to fusing station E.

Fusing station E includes a fuser assembly, indicated generally by the reference numeral 68 which permanently affixes the transferred toner powder image to the copy sheet. Preferably, fuser assembly 68 includes a heated fuser roller 70 and a pressure roller 72 with the powder image on the copy sheet contacting fuser roller 70. In this manner, the toner powder image is permanently affixed to sheet 56. After fusing, chute 74 guides the advancing sheet 56 to catch tray 76 for subsequent removal from the printing machine by the operator.

After the copy sheet is separated from photoconductive belt 10, the residual toner particles and the toner particles adhering to the test patch are cleaned from photoconductive belt 10. These particles are removed from photoconductive belt 10 at cleaning station F. Cleaning station F includes a rotatably mounted fiberous brush 78 in contact with photoconductive belt 10. The particles are cleaned from photoconductive belt 10 by the rotation of brush 78. Subsequent to cleaning, a discharge lamp (not shown) floods photoconductive belt 10 with light to dissipate any residual electrostatic charge remaining thereon prior to the charging thereof for the next successive imaging cycle.

As illustrated in FIG. 2, infrared densitometer 54 detects the density of the developed test patch and produces an electrical output signal indicative thereof. The electrical signal produced by the infrared densitometer is proportional to the reflected light intensity which is related to the change in density.

In addition, an electrical output signal is periodically generated by infrared densitometer 54 corresponding to the bare or undeveloped photoconductive surface. These signals are conveyed to controller 80 through suitable conversion circuitry 82. Controller 80 forms the ratio of the developed test patch signal/bare photoconductive surface signal and generates electrical error signals proportional thereto. The error signal is transmitted to logic interface 84 which processes the error signal so that it controls the respective processing station 86. For example, if the charging station is the processing station being controlled, the logic interface transmits the error signal in the appropriate form to the high voltage power supply to regulate charging of the photoconductive surface.

When toner concentration is being controlled, motor 52 (FIG. 1) is energized causing toner dispenser 40 to discharge toner particles into developer housing 42. This increases the concentration of toner particles in the developer mixture. During operation of the electrophotographic printing machine, any of the selected processing stations can be simultaneously controlled by the control loop depicted in FIG. 2. For example, in addition to controlling charging and toner concentration, the electrical bias applied to the developer roller may also be regulated. By regulating a plurality of processing stations, larger variations from the nominal conditions and faster returns to the nominal conditions are possible. Thus, the various printing machine processing stations have wider latitude.

Figure 3:
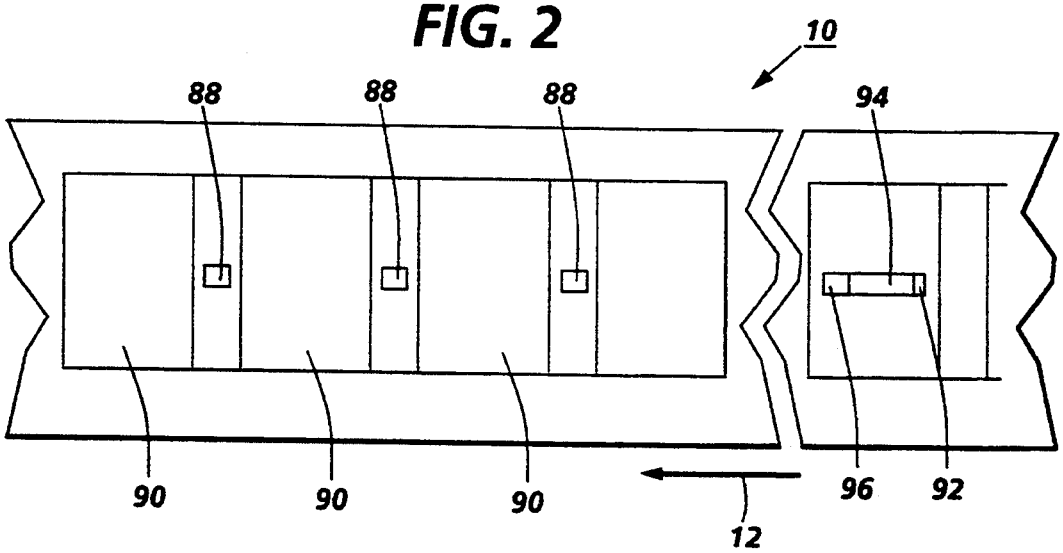
FIG. 3 illustrates a test patch formed on the image region of the photoreceptor in accordance with the present invention.

Referring now to FIG. 3, there is shown test patch 88 recorded in the interimage region of photoconductive belt 10. At the development station, the test patch is developed and infrared densitometer 54 (FIG. 2) detects the density of the developed test patch and generates an electrical signal. It has been discovered in accordance with the present invention that by the periodic development of a test patch illustrated at 94, in the image area 90 of the photoreceptor, sufficient data can be acquired to not only sense the large solid area deterioration previously undetectable, but appropriate adjustments can be made as described below. In particular, initially a reference patch similar to test patch 94 as shown is developed and sensor 54 detects the lead edge and trail edge density of the reference patch.

The reference patch is generated after the changing of developer elements such as developer material and photoreceptor and an electrostatic set up performed. Reference data for the lead edge and trail edge density of the reference patch is stored, for example in memory 80A in FIG. 2, for later comparison with the lead and trail edge density of the test patches 94. The use of the reference data compensates for irregularities and differences in machine components and systems.

Figure 4:
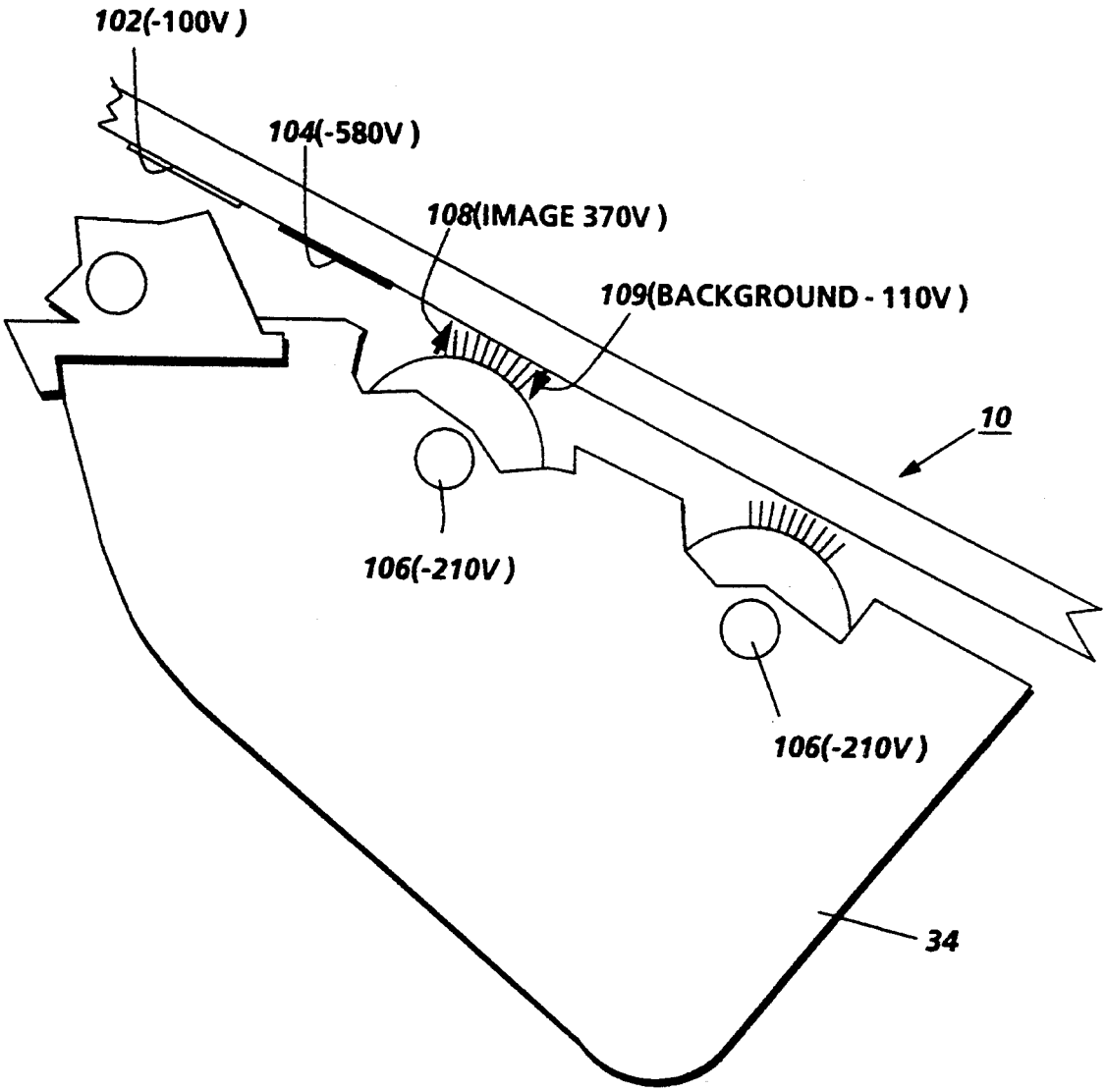
FIG. 4 illustrates typical voltage potential relationships and fields between developer and photoreceptor in the system shown in FIG. 1.

With reference to FIG. 4, after the corona generating device 20 charges the photoconductive belt 10 to a relatively high substantially uniform potential, a document is illuminated by lamps 28. Light rays reflected from the document focus the light image of the original document onto the charged portion of the photoconductive belt to selectively dissipate the charge. The dark areas or image areas of the document reflect less light and therefore dissipate the charge on the photoconductor less than the white or background portions of the document which reflect a large proportion of the light to significantly dissipate the charge on the photoconductive belt. As a result, for example, in one particular embodiment, the charge on the photoconductive belt 10, representing the white or background areas is dissipated to a minus 100 volts and the portion on the photoconductive belt representing the black portions of the document are dissipated to a minus 580 volts as illustrated by 102 and 104 respectively.

With a given bias on the developer rolls of a minus 210 volts as illustrated at 106, this results in a field of 370 volts, referred to as the development or image field illustrated at 108 between the image portions of the document and a field of 110 volts illustrated at 109 between the developer roll and the photoreceptor belt for the white or background areas, referred to as the background field. Due to degradation of component parts of the Xerographic system such as the photoconductive belt and the developer system, various voltages such as the image voltage (−580), bias voltage (−210V), and background voltage (−100V) are subject to change which in turn alter the development field 108 and background field 109.

It has been discovered that the density differential from the lead edge to the trail edge of a relatively large solid areas is measurable as the toner concentration decreases. Under normal process controls, the toner control patch is too small or insufficiently dense to be sensitive to this differential. In accordance with the present invention, with reference to FIG. 3, the density of the lead edge 94 of the large solid area developed patch 92, is determined as well as the density of the trail edge 96. By comparing the lead and trail edge signals to reference lead and trail edge signals, predetermined electrostatic parameters can be adjusted to compensate for large solid area toner concentration decreases. Alternatively, only a density differential between lead and trail edge density of the test patch is detected and the test patch differential used to compensate for large solid area toner concentration decreases.

In a preferred embodiment, at predetermined intervals, a dead cycle is initiated and the normal toner dispense suspended. This dead cycle for example, can be initiated at power on or after the production of a given number of copies or based upon time use of the machine. The patch generator 32 that normally provides the relatively small test patch 88 in the photoreceptor space between images 90, is used to project a large test patch 92 in the image area 90. Preferably, the control patch is one pitch long or the normal image cycle. This is the time period equivalent to the area of the photoreceptor to project and develop a single image.

The patch generator discharges the voltage at the lead and trail edge of the image to a lower level as is well known in order that the developed image will be in the active sense region of the infrared densitometer. The middle of the image remains at a nominal voltage level to simulate a long solid area. Once the image has been generated by the patch generator 32, and developed, the electrostatic volt meter 33 as illustrated in FIG. 1, measures the background voltage on the photoreceptor. That is, after the projection of the image, the potential on the photoreceptor belt corresponding to the white or background areas of the document is measured. This is the background voltage 102 as illustrated in FIG. 4. The image of the patch 92 is developed and the lead and trail edge densities are measured by the densitometer.

Generally, in reproduction machines an electrostatic set up is performed as part of a periodic maintenance. The periodic maintenance could include the replacement of the developer unit or developer materials, changing of the photoreceptor, or any other necessary maintenance procedures. As part of the maintenance, the system is set for a suitable quality product. At this time, in accordance with the present invention, an elongated reference patch in the image area, such as illustrated at 94 in FIG. 3, is developed and the developed reference patch is monitored by the densitometer 54. Electrical signals proportional to the developed reference patch are generated at the leading edge 96 and the trailing edge 92 of the reference patch. Representations of these signals at the leading edge and trailing edge of the reference patch are stored at any suitable memory such as memory 80A of controller 80 shown in FIG. 2. These signals are stored and used as a lead edge and trail edge reference against the signals produced by test patches periodically developed during the operation of the machine.

For any given machine, lead and trail edge signals from developed test patches are compared with the reference lead and trail edge signals stored representations stored in memory at suitable intervals. The interval may vary from machine to machine, for example, at the completion of a set number of copies. For example, in high volume machines the interval could be after the reproduction of 500,000 copies or in much lower volume machines as often as after the completion of 20,000 copies. At any rate, at the proper time a long test patch is generated and developed in the image area of the photoreceptor and the lead and trail edges of the test patch are sensed by desitometor 54.

The lead edge of the sensed test patch is then compared to the lead edge reference signal stored in memory. If the ratio is approximately 1.0, there is no substantial change or difference between the recently measured lead edge of a test patch and the reference lead edge stored in memory. It should be noted that the range or value to determine the substantial or significant difference between measured values is a design choice and can vary dependent upon design considerations and machine environment. If the ratio is approximately 1.0, then the trail edge of the recently measured test patch is compared with the trail edge reference signal stored in memory. If the ratio of the trail edge signals is approximately 1.0, then there is no significant change in the developability in the system. However, if the ratio of trail edge signals significantly differs from 1.0, then a suitable adjustment is made in the development system. Likewise, if the ratio of the leading edge signals differs significantly from 1.0, a suitable change will be made to the development system. It should also be noted that the change to the development system based upon lead edge or trail edge difference is also a design choice. It should be further noted that in the alternative, changes to the development system can be made based upon the test patch lead to trail edge differential rather than comparing to reference signals.

In general, a significant deviation or variation of measured test patch signals from the reference patch signals means there is not enough toner in the toner sump. This requires an adjustment to increase toner concentration. Any suitable method can be used to increase toner concentration. For example, depending upon the relationship of the test lead and trail edges with the reference lead and trail edges, a control value can be changed. That is, a digital or bit value stored in memory used as a reference for toner concentration can be changed to indicate a new level of toner concentration. Alternatively, there could be a decrease in the development field of the test patch.

It should be noted that all sample solid areas, preferably, are imaged on dead cycle frames and would thus not be printed on paper. Upon the detection of a solids rendering problem as indicated by a comparison of the lead and trail edge signals, the xerographic set up or system can be adjusted to compensate or correct for the problem. Another option is simply to declare a fault in systems which are not able to automatically internally correct the fault. Another alternative is to transmit representations of the sensed lead and trail edged signals via modems 110 to a remote service station illustrated at 112 in FIG. 2. At remote service station 112, automatic corrections could be determined and suitable data on instructions transmitted from remote service station 112 to modems 110 to controller 80 to provide suitable corrective action.

Figure 5:
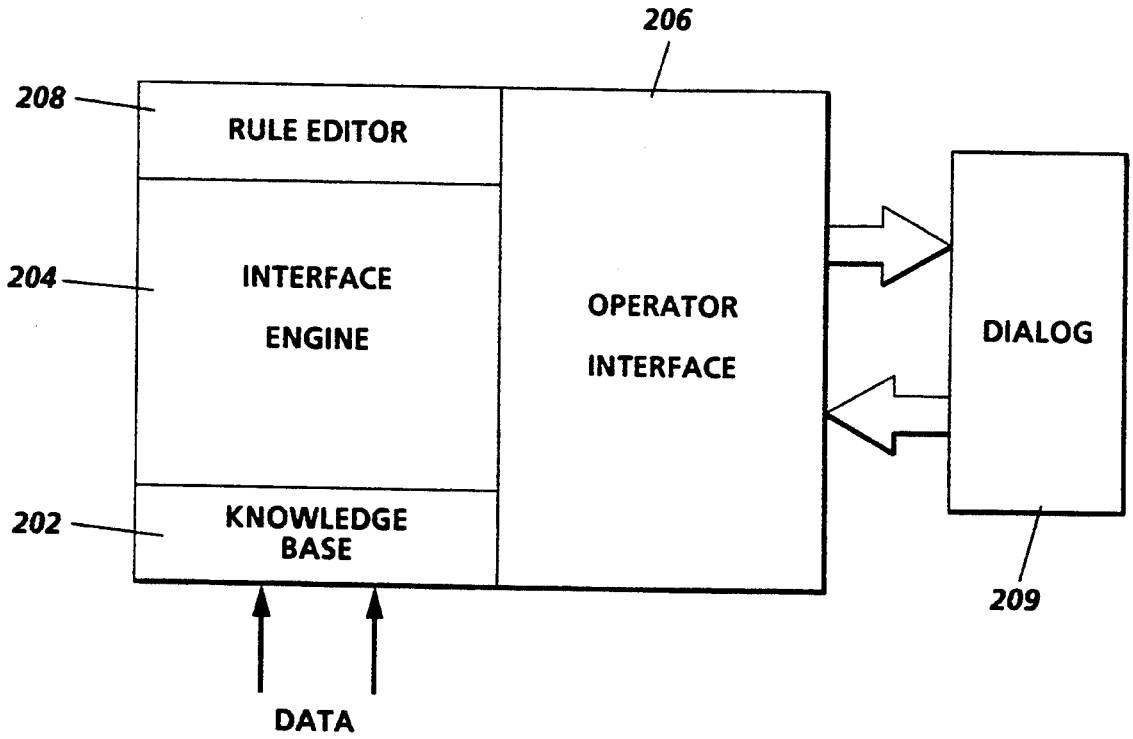
FIG. 5 illustrates atypical expert system incorporated in the remote station shown in FIG. 2.

The remote service station 112 could include an expert system 114 as illustrated in FIG. 5, including a Knowledge Base 202 having a set of rules embodying an expert's knowledge about the operation, diagnosis, and correction of the machine, an Inference Engine 204 to efficiently apply the rules of the Knowledge Base 202 to solve machine problems, an Operator Interface 206 to communicate between the operator and the Expert System, and Rule Editor 208 to assist in modifying the Knowledge Base 202. In operation, the Inference Engine 204 applies the Knowledge Base 202 rules to solve machine problems, compares the rules to data entered by the user about the problem, tracks the status of the hypothesis being tested and hypotheses that have been confirmed or rejected, asks questions to obtain needed data, states conclusions to the user, and even explains the chain of reasoning used to reach a conclusion. The function of the Operator Interface is to provide dialogue 210, that is ask questions, request data, and state conclusions in a natural language and translate the operator input into computer language.

An essential element of the Expert System is the dialogue feature 209 to enable the Expert System to proceed with analysis upon receipt of additional data from an operator or tech rep. The Expert System includes memory with a profile of expected machine performance and parameters portion, a current switch and sensor information portion, and a table of historical machine performance and utilization events. The system monitors status conditions and initiates external communication relative to the status conditions of the machine. This procedure includes the steps of monitoring the predetermined status conditions relative to the operation of the machine, recognizing the deviation of the machine operation from said predetermined status conditions, recognizing the inability of the machine to automatically respond to the deviation to self correct, and, determining the need for external response to provide additional information for evaluation for further analysis. It should be noted that the use of the remote station and expert system is merely an alternative corrective procedure. For further details, reference is made to U.S. Pat. No. 5,138,377 and 5,057,866 incorporated herein.

As stated above, the development field (the voltage of the image on the photoreceptor less the developer bias voltage) and toner patch development field (the voltage of the toner patch less the voltage of the developer bias) could be lowered by a common factor to correct the developer to maintain consistent solid area development. Lowering the toner patch development field would cause the control system to raise the toner concentration, eliminating the toner supply problem and thus the solids rendering problem. The increase in toner concentration increases developability. Lowering the development field prevents the developed mass per unit area from becoming excessive as a result of the developability increase.

Figure 6:
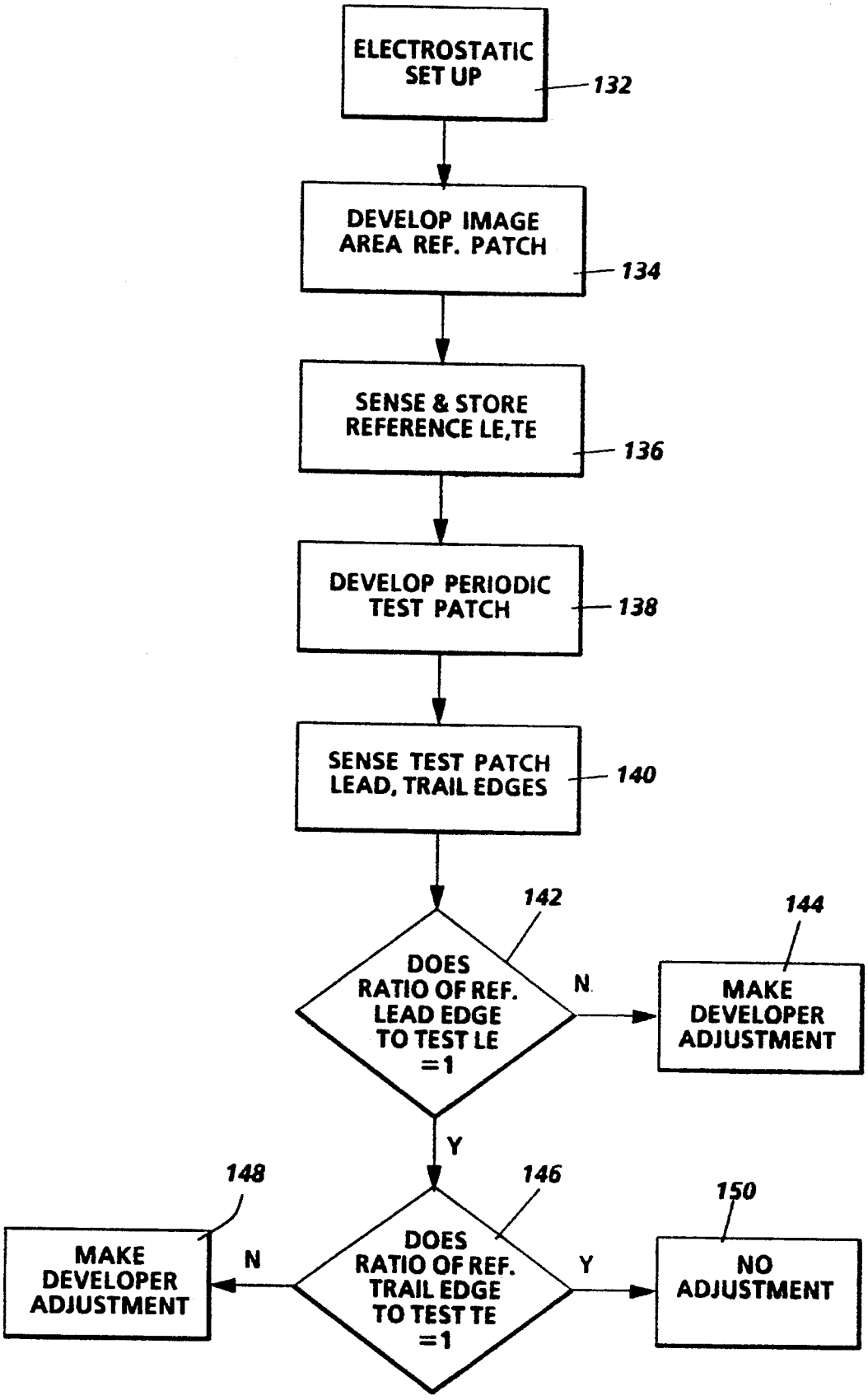
FIG. 6 is a flow chart illustrating the technique of responding to large solid area development deterioration to maintain toner concentration and developed mass at a constant level in accordance with the present invention.

With reference to FIG. 6, block 132 represents the completion of an electrostatic set up for a machine. The electronic set up, generally follows the changing of key components in the machine such as new developer material for the replacement of the photoreceptor. Upon making these type of changes, the tech rep adjusts the machine to a given quality level setting key parameters such as charging voltage and developer bias. After completion of the electrostatic set up, a reference patch is developed in the image area of the photoreceptor. The reference patch is a generally elongated patch that will be the standard or reference for large area solid development of the machine. The developed reference patch is sensed and signals representing the lead edge and trail edge of the elongated patch are stored in memory as illustrated at 136.

Block 138 illustrates the development of periodic test patches to be compared to the reference patch. A typical test patch is illustrated at 94 in FIG. 3 which is also similar to the test patch used to obtain the reference readings shown at block 136. At block 140, the lead edge and trail edges 96 and 92 of the test patch are sensed. As discussed above, the routine or periodic development and sensing of a test patch varies with the type machine as well as the machine environment.

It should be understood that once the lead and trail edge measurements for the test patch have been obtained, the scope of the present invention covers any suitable method to compare the sample test readings with the reference readings and to make appropriate corrections to the developer system. In one embodiment, as illustrated at decision block 142, the ratio of the reference lead edge signal to the test patch lead edge signal is determined. If the ratio is not substantially one, that is, there is a significant or substantial difference between the lead edge signal of the reference patch to the lead edge signal from the test patch, then a developer adjustment is made as shown at block 144. The adjustment can be any suitable adjustment such as changing a quality bit or indicator stored in memory or to decrease the development field for the development of the test patch or to proportionally adjust the patch development and solid development fields. It should be understood that any suitable adjustment is contemplated for a particular development system and related electrostatic fields that compensates for the developer system aging. If, on the other hand, the ratio of the lead edge signals of the test and reference patches are substantially equal, then there is a determination of the ratio of the trail edge signals from the test patch and reference patch as shown at block 146. If there is a significant difference, then a developer adjustment is made as shown at block 148. The adjustment made as indicated at block 148 will be any suitable adjustment that will compensate for the unequal relationship of the trail edge signals of the reference and test patches. If there is not a significant difference in both the lead and trail edge signals between the test patch and the reference patch, then as shown at block 150 no adjustment will be made.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In a machine having an imaging surface, a projecting system for projecting an image onto the imaging surface, a developer for application of developer material to the image projected onto the imaging surface for transfer of the image to a copy sheet, the developer responding to a given set point, the method of adjustment of the developer comprising the steps of;

sensing a toner mass on a reference developed patch within an interimage space on the imaging surface, storing reference data representing lead edge and trail edge toner mass on the reference developed patch, sensing lead edge and trail edge toner mass of a developed test patch within the interimage space on the imaging surface, comparing the reference data representing lead edge and trail edge toner mass on the reference developed patch with the lead edge and trail edge toner mass of the developed test patch and, adjusting the developer in response to comparing the reference data representing lead edge and trail edge toner mass with the lead edge and trail edge toner mass of the developed test patch.

2. The method of claim 1 wherein the step of comparing the reference data representing lead edge and trail edge toner mass on the reference developed patch with the lead edge and trail edge toner mass of the developed test patch includes the step of determining the reference lead edge to test patch lead edge ratio.

3. The method of claim 2 including the step of determining the reference trail edge to test patch edge ratio.

4. In a machine having an imaging surface, a projecting system for projecting an image onto the imaging surface, a developer controlled by a given set point for application of developer material to the image projected onto the imaging surface, and a control storing a reference for developer quality, the method of adjustment of the developer set point comprising the steps of:

developing a test patch on the imaging surface determining toner concentration on the test patch developed on the imaging surface including the step of determining the lead edge and trail edge toner concentration on an elongated test patch, comparing the toner concentration on the test patch with the reference for developer quality and selectively adjusting the set point in response to said comparing.

5. The method of claim 4 wherein the reference for developer quality includes a lead edge and trail edge toner concentration measurement on a reference test patch.

6. The method of claim 5 wherein the step of comparing the toner concentration on the test patch with the reference for developer quality includes the step of comparing lead edge and trail edge ratios.

7. The method of claim 4 wherein the step of selectively adjusting the set point includes the step of altering a toner concentration control value.

8. The method of claim 4 wherein the step of selectively adjusting the set point includes the step of decreasing the development field of the test patch.

9. A machine having an imaging surface, a projecting system for projecting an image onto the imaging surface, a developer effected by a given set point for application of developer material to the image projected onto the imaging surface, and a control storing a reference for developer quality, the control including:

means for developing an elongated test patch with toner on the imaging surface, means for determining a lead edge and trail edge toner concentration on the elongated test patch, a sensor for determining toner concentration on the test patch developed on the imaging surface, a comparator relating toner concentration on the test patch with the reference for developer quality, and a device for selectively adjusting the set point in response to said comparing.

10. The machine of claim 9 including means to store a lead edge and trail edge toner concentration measurement from a reference test patch.

11. The machine of claim 9 wherein the comparator relating the toner concentration on the test patch with the reference for developer quality includes logic for comparing lead edge and trail edge ratios.

12. The machine of claim 9 wherein the device for selectively adjusting the set point includes means for altering a toner concentration control value.

13. In a network interconnecting an imaging machine and a remote station, the imaging machine having an imaging surface, a projecting system for projecting an image onto the imaging surface, a developer effected by a given set point for application of developer material to the image projected onto the imaging surface, the remote station including a device to evaluate imaging machine quality, at least one of the machine and remote station having a memory for storing a reference for machine developer quality, the method of adjustment of the developer set point comprising the steps of:

developing a test patch on the imaging surface, determining toner concentration on the test patch developed on the imaging surface including the step of determining a lead edge and trail edge toner concentration on an elongated test patch, comparing the toner concentration on the test patch with the reference for machine developer quality, transmitting a result of the comparing to the remote station over the network and selectively adjusting the set point in the machine in response to said result.

14. The method of claim 13 wherein the remote station includes an expert system for evaluating imaging machine quality and transmitting data to the imaging machine for selectively adjusting the set point.

15. The method of claim 13 wherein the reference for developer quality includes a lead edge and trail edge toner concentration measurement of a reference test patch.

16. The method of claim 13 wherein the step of comparing the toner concentration on the test patch with the reference for developer quality includes the step of comparing lead edge and trail edge ratios.

17. The method of claim 13 wherein the step of selectively adjusting the set point includes the step of altering a toner concentration control value.

18. In a machine having an imaging surface, a projecting system for projecting an image onto the imaging surface, a developer controlled by a given set point for application of developer material to the image projected onto the imaging surface, the method of adjustment of the developer set point comprising the steps of:

developing a test patch on the imaging surface, determining toner concentration of a first portion and a second portion of the test patch developed on the imaging surface, comparing the toner concentration of the first portion and the second portion of the test patch, and selectively adjusting the set point in response to said comparing.

19. The method of claim 18 wherein the step of determining toner concentration on the test patch includes the step of determining a lead edge and trail edge toner concentration on an elongated test patch.

20. The method of claim 18 wherein the step of selectively adjusting the set points includes the step of altering a toner concentration control value.

21. The method of claim 18 wherein the step of selectively adjusting the set points includes the step of decreasing a development field of the test patch.

* * * * *